US005293171A

United States Patent [19]

Cherrette

[11] Patent Number: 5,293,171

[45] Date of Patent: Mar. 8, 1994

[54] PHASED ARRAY ANTENNA FOR EFFICIENT RADIATION OF HEAT AND ARBITRARILY POLARIZED MICROWAVE SIGNAL POWER

[76] Inventor: Alan R. Cherrette, 36-03 Ravens Crest Dr., Plainsboro, N.J. 08536

[21] Appl. No.: 44,622

[22] Filed: Apr. 9, 1993

[51] Int. Cl.[5] ..... H01Q 1/38; H01Q 21/00

[52] U.S. Cl. ..... 343/700 MS; 343/853; 343/DIG. 2

[58] Field of Search ..... 343/700 MS, 853, DIG. 2; 342/372; H01Q 1/38, 21/00

[56] References Cited

U.S. PATENT DOCUMENTS

| | | | |
|---|---|---|---|
| 4,987,425 | 1/1991 | Zahn et al. | 343/700 MS |
| 5,087,920 | 2/1992 | Tsurumaru et al. | 343/700 MS |
| 5,160,936 | 11/1992 | Braun et al. | 343/700 MS |

FOREIGN PATENT DOCUMENTS

| | | | |
|---|---|---|---|
| 60-10806 | 1/1985 | Japan | 343/700 MS |

*Primary Examiner*—Donald Hajec
*Assistant Examiner*—Hoanganh Le

[57] ABSTRACT

According to the present invention, a thin, lightweight active phased array antenna panel is provided that efficiently radiates heat and arbitrarily polarized microwave signal power. The active array panel also efficiently reflects solar power so as to minimize solar heating. The active array panel includes a plurality of subarray elements each of which includes a plurality of aperture coupled patch radiators. The exterior surface of the subarray element is covered with silvered second surface mirrors to provide efficient radiation of heat in the presence of sunlight. A microstrip feed network in the subarray element is embedded in a dielectric material with a high thermal conductivity to efficiently distribute heat. The active array further includes an electronics module for each subarray element. The electronics module contains a solid state power amplifier, phase shifter and associated electronics mounted in a housing made of material with high thermal conductivity. Each electronics module and corresponding subarray element are thermally and electrically connected to each other and to a support structure assembly with silver-quartz mirrors bonded to the lower exterior surface. Heat generated by the circuits in the electronics module is conducted through the housing and transferred to the outer surfaces of the subarray element and support structure assemblies where it is radiated into space.

9 Claims, 9 Drawing Sheets

PHASED ARRAY ANTENNA FOR EFFICIENT RADIATION OF HEAT AND ARBITRARILY POLARIZED MICROWAVE SIGNAL POWER

FIELD OF THE INVENTION

This invention relates to phased array antennas on communication satellites and more particularly to a lightweight active phased array antenna that provides efficient radiation of arbitrarily polarized microwave signal power as well as efficient radiation of heat in the vacuum of space and in the presence of sunlight.

BACKGROUND OF THE INVENTION

To give those skilled in the art an appreciation for the advantages of the present invention, it is necessary to understand the context in which the invention will be used. Since this invention will be used in communication satellite payloads and its use will require a departure from conventional communication satellite design, a brief summary of prior art in satellite payload design will be given to provide an understanding of the numerous advantages obtained through the use of the present invention.

Communication satellites employ payloads that all operate in the same basic fashion. A signal received with a receive antenna is passed through a repeater and then transmitted with a transmit antenna. The receive antenna serves to discriminate which directions the receive signal power will be admitted. The transmit antenna serves to discriminate which directions the transmit signal power will be directed. The directional properties of transmit and receive antennas are characterized by their antenna directivity patterns. The repeater performs several basic functions as follows:

1) It performs low noise amplification of the received signal and filters out signals not in the receive band.
2) It translates the signal from the receive frequency to the transmit frequency and filters out signals not in the transmit band. This is done to prevent transmit signal feedback from corrupting the received signal.
3) It amplifies the signal to the required output power level to close the communication link.

Commercial communication satellite payloads generally consist of reflector antennas and channelized repeaters. This type of payload is selected because it allows DC power supplied by the spacecraft to be efficiently converted into radiated microwave signal power with the proper antenna directivity pattern. Reflector antennas for transmitting and receiving can produce high gain shaped contour directivity patterns with very little loss. This is particularly true of shaped reflector antennas where the need for a beamforming network and the associated losses are eliminated.

Channelized repeaters have the advantage of efficiently converting DC power supplied by the spacecraft into microwave signal power. This is accomplished in the process of amplifying the signal to the required output power level. Advantage is taken of the fact that the signal is generally composed of individual frequency components known as carriers. Each individual carrier in the signal is filtered out and passed through its own individual channel. Each channel contains an amplifier that is driven into saturation by the carrier in order that DC to microwave power conversion efficiency be maximized. Typically, amplifier power conversion efficiency can be as high as 50% (half of the DC power is converted to microwave signal power) for Traveling Wave Tube Amplifiers (TWTAs) and a little above 40% for Solid State Power Amplifiers (SSPAs) depending on the frequency. The respective amplified carriers from each channel are then filtered and combined in an output multiplexer to form the amplified signal to be passed to the transmit antenna.

It should be noted that if a signal consisting of multiple carriers is used to drive a single amplifier into saturation, the amplified signal would be degraded by intermodulation interference resulting from the nonlinear transfer characteristics of the saturated amplifier. To reduce the intermodulation interference to an acceptable level, the amplifier needs to be operated in a more linear region so the power level of the signal applied to the amplifier has to be reduced 50% to 60%. This results in amplifier power conversion efficiency dropping to the 20% range.

Although conventional payloads consisting of reflector antennas and channelized repeaters have an advantage in power conversion efficiency, there is a major drawback to this type of design. The drawback is flexibility. The directivity pattern of a reflector antenna is determined by the physical construction of the feed array and beamforming network or the shape of the reflector surface. These attributes are not easily changed particularly in orbit. The output multiplexer of a channelized repeater is required to have very low loss; consequently, it is constructed of waveguide filters and couplers. Once the repeater is constructed, the frequency allocations of the individual carriers can not be changed. The result is a relatively expensive custom designed spacecraft that has limited value for missions other than the one it was specifically designed for.

For many years it has been known that phased array antennas can provide the flexibility of electronic control of antenna directivity pattern shape and position. A phased array is a collection of many antennas or antenna elements that radiate individual coherent signals that are phase and amplitude weighted to provide constructive interference in some directions and destructive interference in other directions. The directional properties of the constructive and destructive interference, characterized by the antenna directivity pattern, can be modified by changing the amplitude and phase weighting of the antenna elements. The antenna element weighting is accomplished in the beamforming network.

Earlier phased array designs used passive phase shifting and power dividing components employing ferrite to control the weighting of the antenna elements. No signal amplification occurred in the antenna elements or beamforming network. This architecture, generally referred to as a passive phased array, provided directivity pattern flexibility but had the disadvantage of being heavy and expensive since the beamforming network needed to be made of metallic waveguide components to minimize loss. For commercial communication satellite applications, where low weight and low loss are of the utmost importance, the weight and loss of the passive phased array proved to be much higher than conventional designs and consequently the passive phased array never really caught on.

More recent phased array work has involved using amplifiers at each antenna element in the array. This type of phased array is generally referred to as an active phased array. An amplifier at each antenna element allows the use of more lossey beamforming network technologies such as microstrip and Monolithic Microwave Integrated Circuit (MMIC) devices for phase shifting and attenuating. This provides the potential to greatly reduce weight, size and cost of the active array. The use of active arrays also allows more lossey repeater technologies such as Surface Acoustic Wave (SAW) devices for filtering and MMICs for signal processing and routing. This eliminates the need for much of the hardware in conventional repeaters such as waveguide multiplexers and filters, high power Traveling Wave Tube Amplifiers (TWTAs) and redundancy rings, and the associated waveguide runs and support structure. The result is large reductions in weight, size and cost of the repeater. However, it should be noted that transmit active phased arrays have two major problems as follows:

1) Each element amplifier sees all carriers in a signal; consequently, the amplifier needs to be operated in a more linear region resulting in amplifier power conversion efficiency dropping to the 20% range as mentioned above.
2) Getting rid of waste heat is complicated by the low power conversion efficiency and the orientation of the array.

As a consequence of low amplifier efficiency, payloads with active phased arrays require more bias power and dissipate more heat than conventional payloads with the same communication specifications. Therefore, a spacecraft with active phased arrays requires a larger heavier power supply subsystem (i.e. larger solar cell arrays, more batteries etc.). For reliability, the junction temperature of each Solid State Power Amplifier in each array element must be maintained below 100° C. and temperature swings should be kept below 50° C. Since there is a larger amount of waste heat to be rejected with active arrays and there is no convection cooling in space, maintaining the proper temperature specifications becomes very difficult. The thermal design is further complicated by the fact that the radiating surface of the array is directed towards the Earth; consequently, the radiating surface of the array is exposed to solar radiation with near normal incidence for arrays in geostationary orbit. Thus, solar heating of the array also becomes a problem.

Linearizing circuits have been used to improve the efficiency of amplifiers used with multicarrier signals and research in this area is the subject of active investigation.

Several solutions to the thermal problems of active arrays have also been proposed. For example, D. Michel, et al in "A Ku-Band Active Antenna Program", *AIAA 14th International Communications Satellite Conference,* Washington D.C., Mar. 22–26, 1992, pp. 1261–1271, describes one of the more common solutions that employs the use of heat pipes on the back side of the active array to conduct heat to separate thermal radiators on the north and south sides of a body stabilized spacecraft. Solar heating of the radiating surface of the array was minimized by the use of thermal control paints. This design works well and has a lot of heritage but it has the disadvantage of being very heavy. Thermal control paints also degrade relatively quickly.

Radiating heat out of the north and south sides of a body stabilized communication satellite is a standard technique for conventional payloads where all the high power amplifiers are mounted on the inward sides of the north and south thermal radiating panels and heat pipes imbedded in each panel distribute the waste heat uniformly.

A. Molker, in "High-Efficiency Phased Array Antenna for Advanced Multibeam; Multiservice Mobile Communication Satellite", *3rd International Conference on Satellite Systems for Mobile Communications & Navigation,* London, England, Jun. 7–9, 1983, pp. 75–77, describes a rather novel technique of attaching silvered second surface mirrors to the bottom of the reflector on a short back-fire antenna element to reject heat and mounting an active array of such elements on the nadir face of a body stabilized spacecraft. This design eliminates the expense and weight of a heat pipe network and the mirrors minimize the effects of solar heating but it can radiate only low thermal power densities (less than 20 Watts per square foot).

Perhaps the most advanced thermal design concept for active phased arrays has come from the spaced based radar field. L. M. Herold, et al in L. J. Cantafio (editor), *Spaced Based Radar Handbook,* Norwood, Mass.: Artech House, Inc, 1989, pp. 319–348, describes using the active array as both a microwave and thermal radiator like A. Molker but proposes that the active array be constructed as a thin panel structure to allow heat to be radiated out of both sides. Provided that the surface thermal properties are properly designed, relatively large thermal power densities (about 60 Watts per square foot) can be radiated using this concept because at least one of the array sides is not facing the sun at any particular time. No details were disclosed by L. M. Herold, et al about the actual construction of such an array panel.

A pending U.S. patent application entitled "Phased Array Antenna for Efficient Radiation of Microwave and Thermal Energy" by inventor Alan R. Cherrette and assigned to Hughes Aircraft Company on Feb. 26, 1993 discloses a thin light weight active array panel that uses silvered second surface mirrors to form a novel and efficient microwave and thermal radiating surface on one side of the panel and an efficient thermal radiating surface on the opposing side. Use of such active array panels in a communication satellite payload significantly reduces payload weight and cost compared to conventional payload designs. The active array payload weight reduction may also offset the weight increase in the spacecraft power subsystem required to compensate for the low amplifier efficiency discussed earlier. The disclosure above does have a major deficiency however, and that is that only linear polarized microwave power can be produced.

The present invention corrects this deficiency by providing a novel microwave and thermal radiating surface where the microwave power can be produced in any polarization. In fact, with this invention the polarization can even be electronically controlled. These and other features and advantages of the present invention will become apparent from the following descriptions.

SUMMARY OF THE INVENTION

According to the present invention, a thin, lightweight active phased array panel is provided that efficiently radiates heat and microwave signal power out of one side and radiates heat only out of the other side. Both sides of the active array panel efficiently reflect solar power so as to minimize solar heating. For descriptive purposes, the side which radiates both heat and microwave power will be referred to as the top side. The side that radiates only heat will be referred to as the bottom side.

The active phased array panel includes a plurality of subarray elements, each of which serves to efficiently distribute and radiate both heat and microwave signal power. The subarray elements also serve to efficiently reflect solar power. The subarray element structure includes a plurality of patch radiators and a microstrip feed network for distributing and radiating microwave signal power. Coupling slots are etched into a ground plane common to both the patch radiators and the microstrip feed network. The coupling slots communicate microwave signal power between the feed network and patch radiators. A silvered second surface mirror is bonded to the outside surface of each patch radiator substrate to form the patch radiator. The patch radiators are in turn attached to a larger silvered second surface mirror. So as not to obstruct the microwave signal power coupled to each patch radiator, the silver coating on the larger mirror is removed in a plurality of areas that correspond in shape and number with the plurality of patch radiators. The larger mirror with patch radiators is attached to the ground plane of the microstrip feed network. Coupling slots in the ground plane that is common to both patch radiators and microstrip feed network are within the uncoated areas in the larger mirror. The substrate and superstrate of the microstrip feed network are made of a dielectric with high thermal conductivity such as aluminum nitride. An input connector to the microstrip feed network is also provided for receiving microwave signal power.

The active array further includes an electronics module for each subarray element. The electronics module serves to amplify and phase shift the microwave signal and conduct dissipated heat away from the electronic devices. The electronics module consists of a housing of aluminum and includes input connections, output connections, and associated electronics. The output connector extends through the module housing and attaches to the input connector on the subarray element to communicate microwave signal power to the feed network and patch radiators. The electronics module is also thermally connected to the subarray element so that heat flows freely between the two.

The array further includes a support structure to provide structural support for the subarray elements and electronics modules. The support structure also serves to distribute DC power, microwave signals, and control signals to each electronics module. The support structure further serves to efficiently distribute and radiate heat. It is constructed of a multilayered board with two aluminum honeycomb panels bonded to each side. The aluminum honeycomb panels provide a light rigid structure and high thermal conductivity. Silvered second surface mirrors are bonded to the exterior surface of the lower aluminum honeycomb panel to provide efficient radiation of heat in the presence of sunlight. The upper aluminum honeycomb panel has portions cut out that correspond in size to the electronics modules and serve as receptacles for receiving the electronics modules. The multilayered board contains signal and power distribution lines and can be made out of various microwave laminates such as Rogers Corp. TMM10. The multilayered board has output connectors that attach to the input connectors on the electronics module. Microwave signal power, DC power, and control signals are communicated through these connectors.

The electronics module is thermally and electrically connected to the support structure that makes up the bottom side of the active array and to the subarray element that makes up the top side of the active array. Heat generated by the electronics module is conducted through the aluminum housing of the active electronics modules and transferred to the top and bottom surfaces where it is radiated into space. The silvered second surface mirrors on the top and bottom exterior surfaces of the active array panel provide efficient radiation of heat in the presence of sunlight. Since there are many identical subarray elements and electronic modules in the active array, the heat sources are uniformly distributed over the aperture area of the array. Consequently, the need for heat pipes and thermal doublers is eliminated. The passive thermal design, along with a structure that combines microwave and thermal radiating functions and mechanical support, greatly reduces the weight and cost of the communication payload. Use of the patch radiator allows linear or circular polarized microwave radiation to be produced by modifying only the microstrip feed network and coupling slots with no impact on the thermal design.

BRIEF DESCRIPTION OF THE DRAWINGS

A more thorough understanding of the present invention may be had from the following detailed description, which should be read with the drawings, in which.

DETAILED DESCRIPTION OF THE PREFERRED EMBODIMENT

Figure 1:
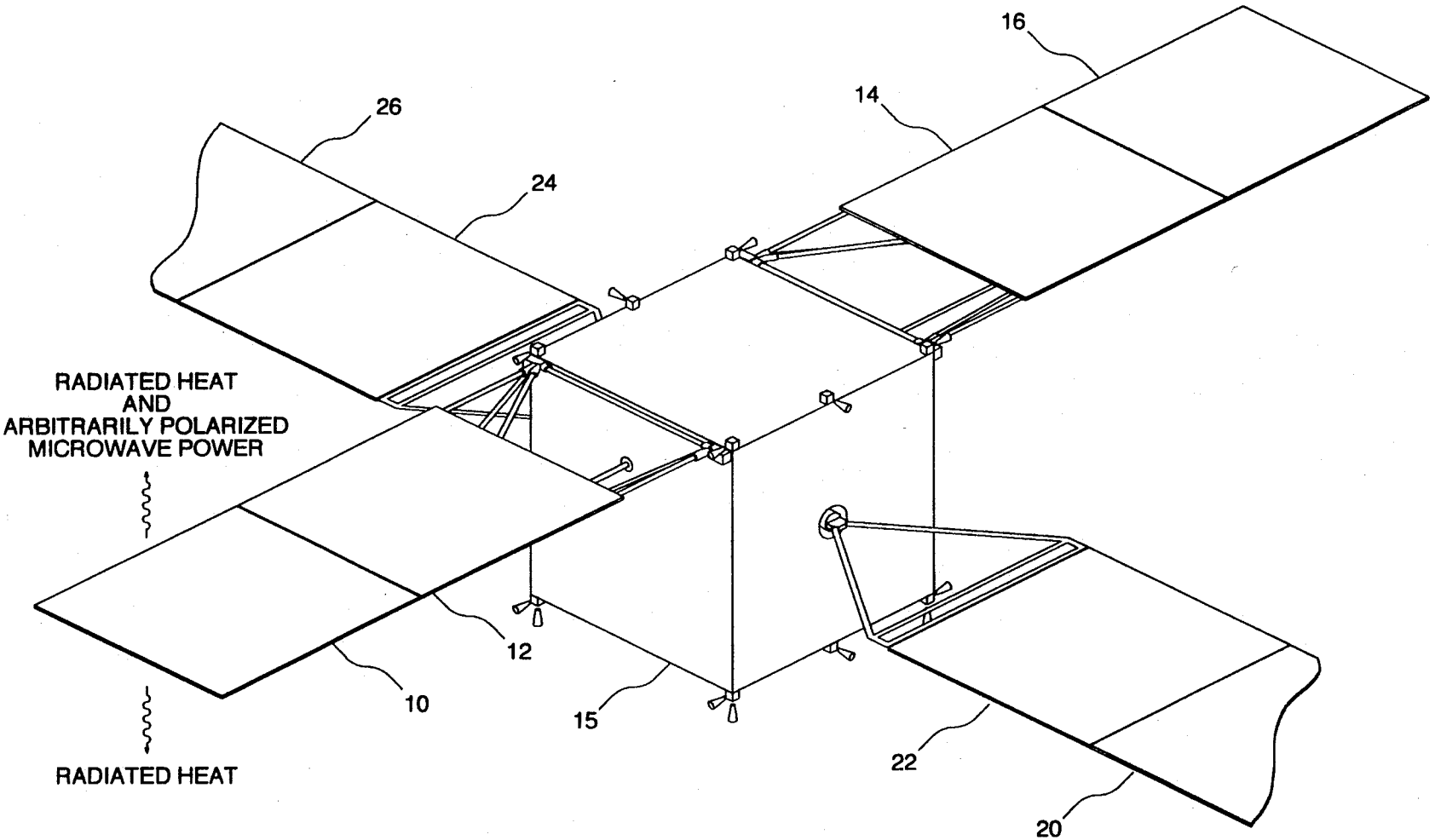
FIG. 1 depicts a set of active phased array antenna panels deployed from a body stabilized spacecraft in a manner similar to the standard deployment of solar panels.

Referring now to the drawings and initially to FIG. 1, a set of active array antenna panels 10, 12, 14 and 16 are deployed from a body stabilized spacecraft 15 in a similar manner to the standard deployment of solar panels 20, 22, 24 and 26. This allows opposing exterior surfaces of each active array panel to have a relatively unobstructed view of space which aids the radiation of heat. Each active array panel 10, 12, 14 and 16 radiates heat and microwave signal power out of one exterior surface and radiates only heat out of the opposing exterior surface. Both of said exterior surfaces efficiently reflect solar power so as to minimize solar heating of the active array panel. For descriptive purposes, the exterior surface which radiates both heat and microwave power will be referred to as the top exterior surface. The exterior surface that radiates only heat will be referred to as the bottom exterior surface.

Figure 2:
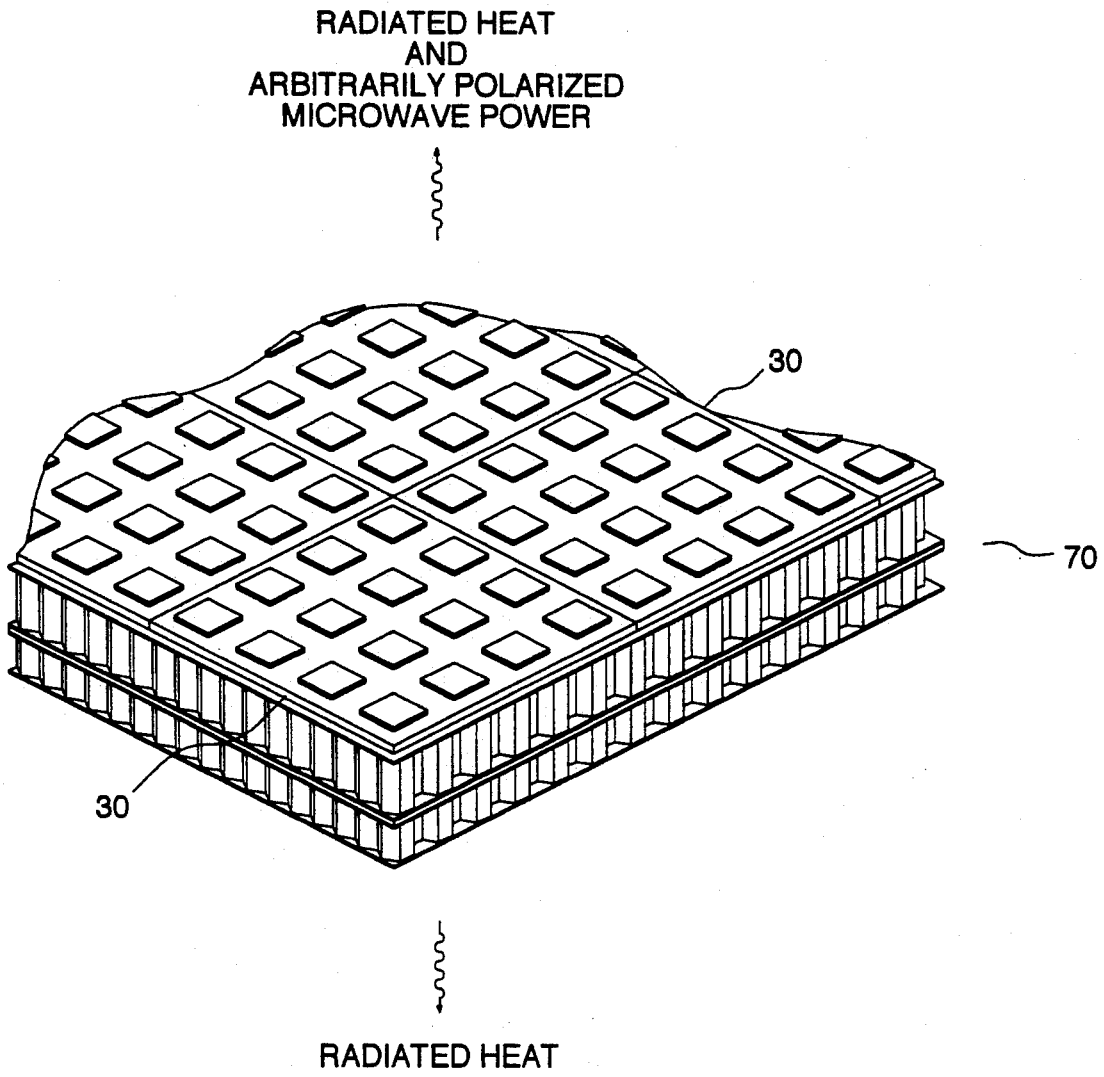
FIG. 2 depicts a cut away view of the corner of an active array panel showing the detail of the subarray elements.

Referring now to FIG. 2, the top exterior surface of each active array antenna panel comprises many subarray elements, the number depending on the antenna directivity pattern, the radiated microwave signal power and DC to microwave power conversion efficiency. These subarray elements, generally designated 30, are assembled along with the associated electronics on a support structure 70 to form an active array panel such as 10. For a given Effective Isotropic Radiated Power over a particular coverage area, the dissipated power density in an active array panel 10 decreases as the number of subarray elements increases. When the number of subarray elements is large enough, the array area is sufficient to radiate the dissipated thermal power while maintaining a reasonable surface temperature on the panel. The antenna directivity pattern shape and position is controlled electronically by changing the relative phase relations among the microwave signals radiated by each subarray element. As an example, for typical commercial communication satellite applications at Ku band, any where from 50 to 400 subarray elements may be needed.

Figure 3:
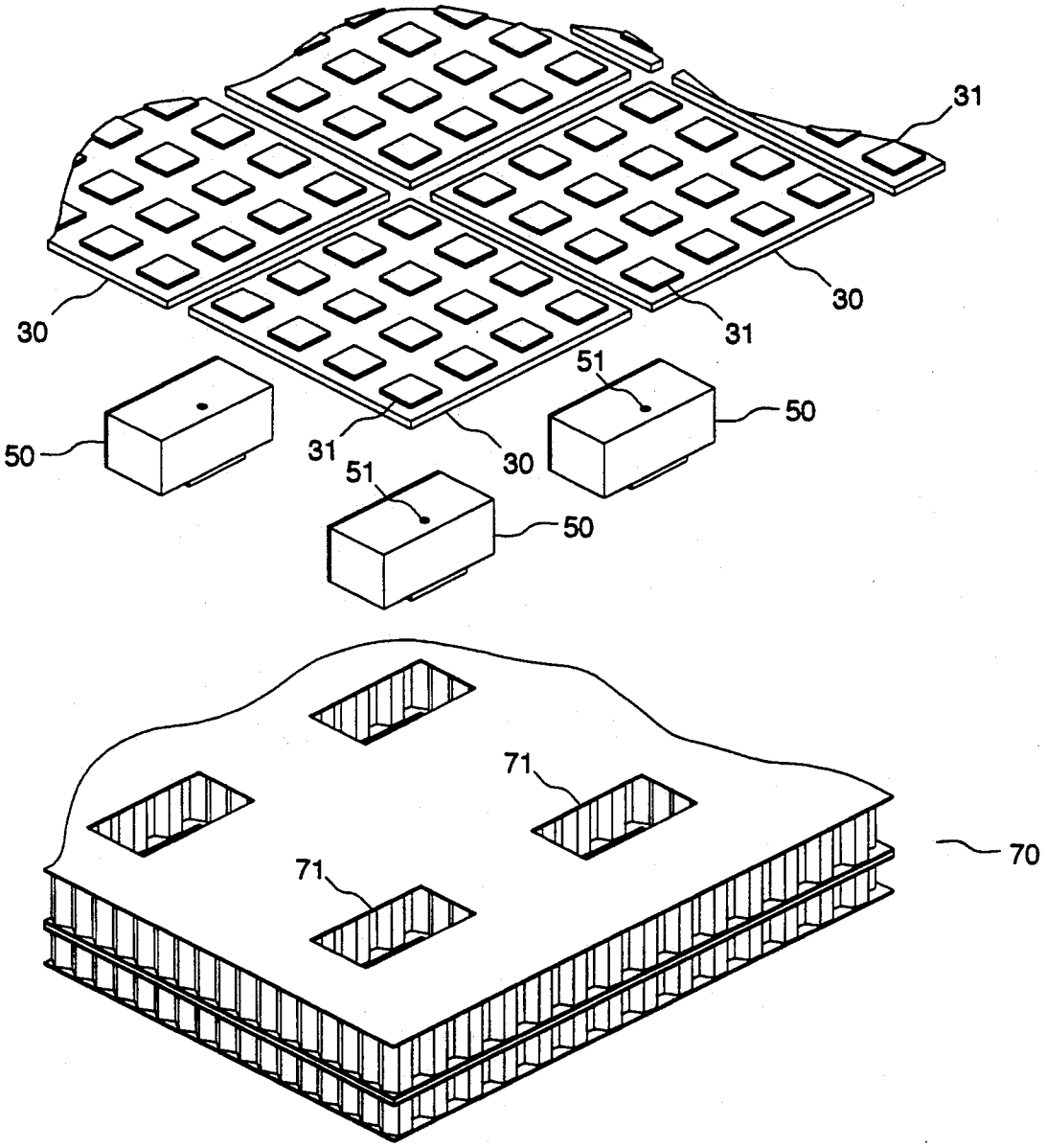
FIG. 3 depicts an exploded view of FIG. 2 showing the major components which comprise the active array panel.

Referring now to FIG. 3, a subarray element 30 comprises a plurality of individual patch radiators 31 on the top exterior surface, each of which is capable of radiating microwave power in any sense of polarization including linear polarization and circular polarization. Each subarray element 30 efficiently distributes and radiates both heat and microwave signal power. Each subarray element 30 also efficiently reflects solar power off the top exterior surface so as to minimize solar heating.

An electronics module generally designated 50 is provided for each subarray element 30. Microwave signal power is generated from electronic devices housed within an electronics module 50, and communicated by way of output connector 51 to a microstrip power distribution network contained in subarray element 30. Each patch radiator 31 receives microwave signal power from said microstrip power distribution network contained in subarray element 30. The electronics devices in the module 50 may include a solid state power amplifier, variable phase shifter, variable attenuator and control circuitry.

A support structure assembly 70 is provided for mechanical support of the subarray elements 30 and electronics modules 50. Each electronics module 50 is supplied with microwave signals, control signals and DC bias power over transmission lines in a multilayered circuit board contained in the support structure 70. The support structure assembly 70 efficiently distributes heat through the structure and radiates heat out of the bottom exterior surface.

Figure 4:
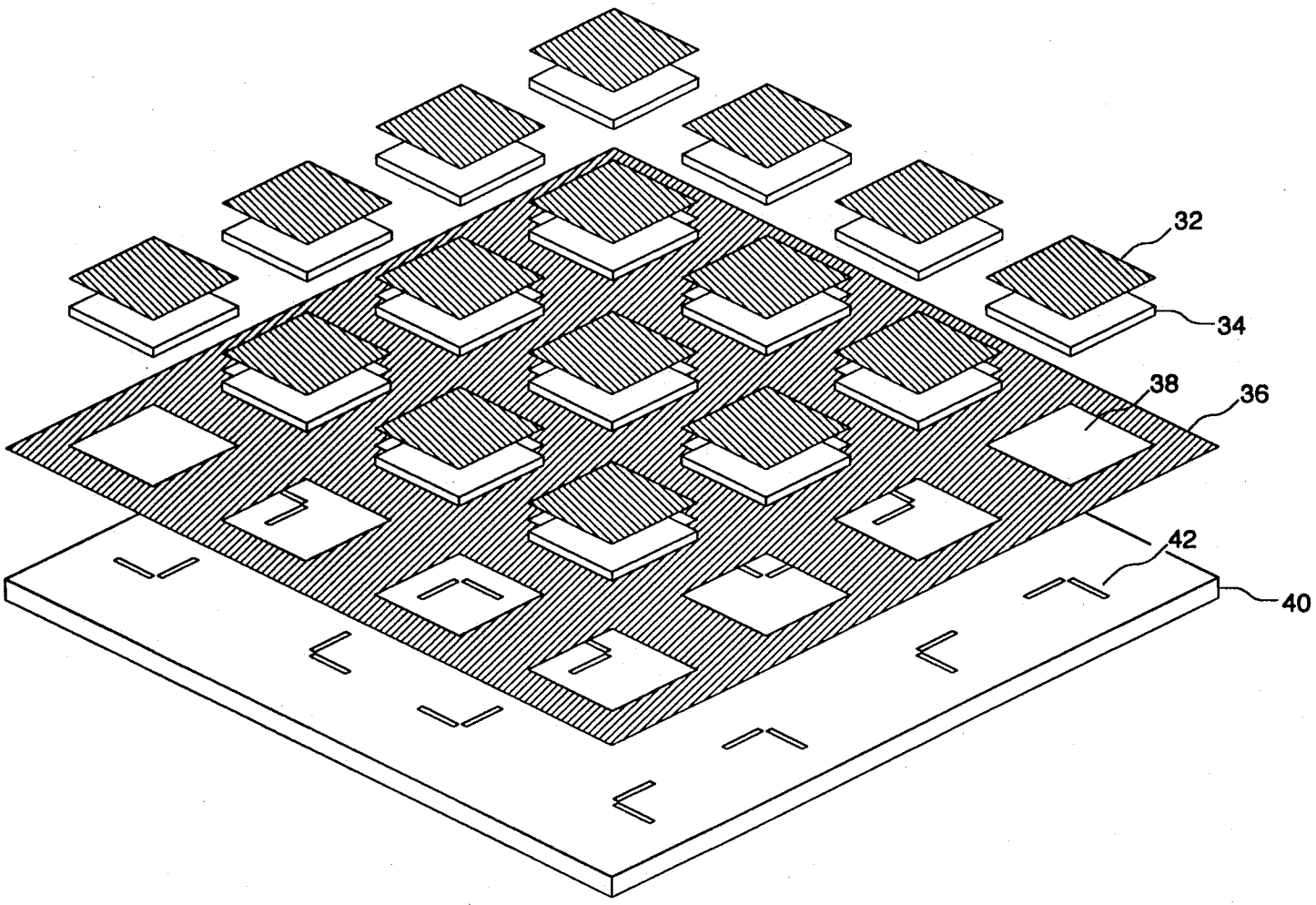
FIG. 4 depicts an exploded view of a subarray element shown in FIG. 3.
Figure 5:
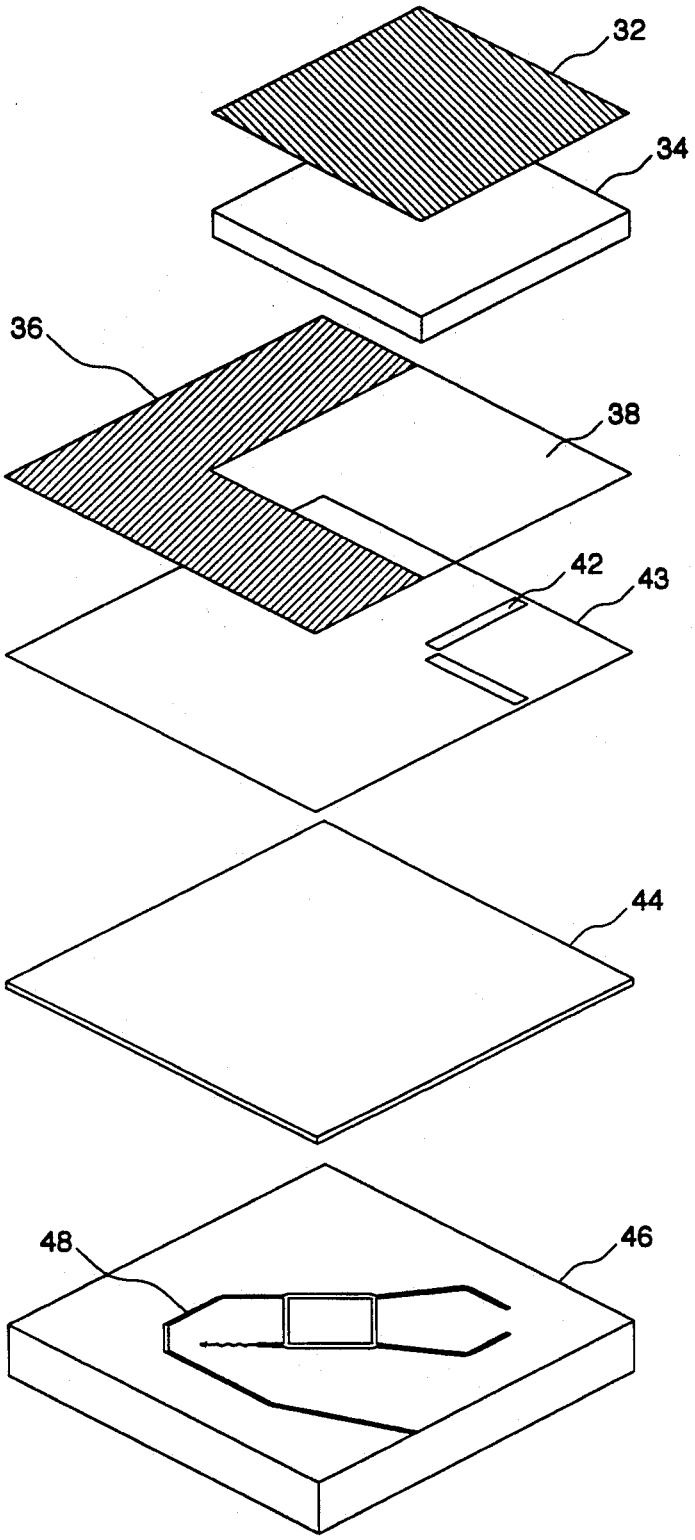
FIG. 5 depicts a cut away view of the subarray element of FIG. 4 in the vicinity of a single patch radiator showing the layered construction.
Figure 6A:
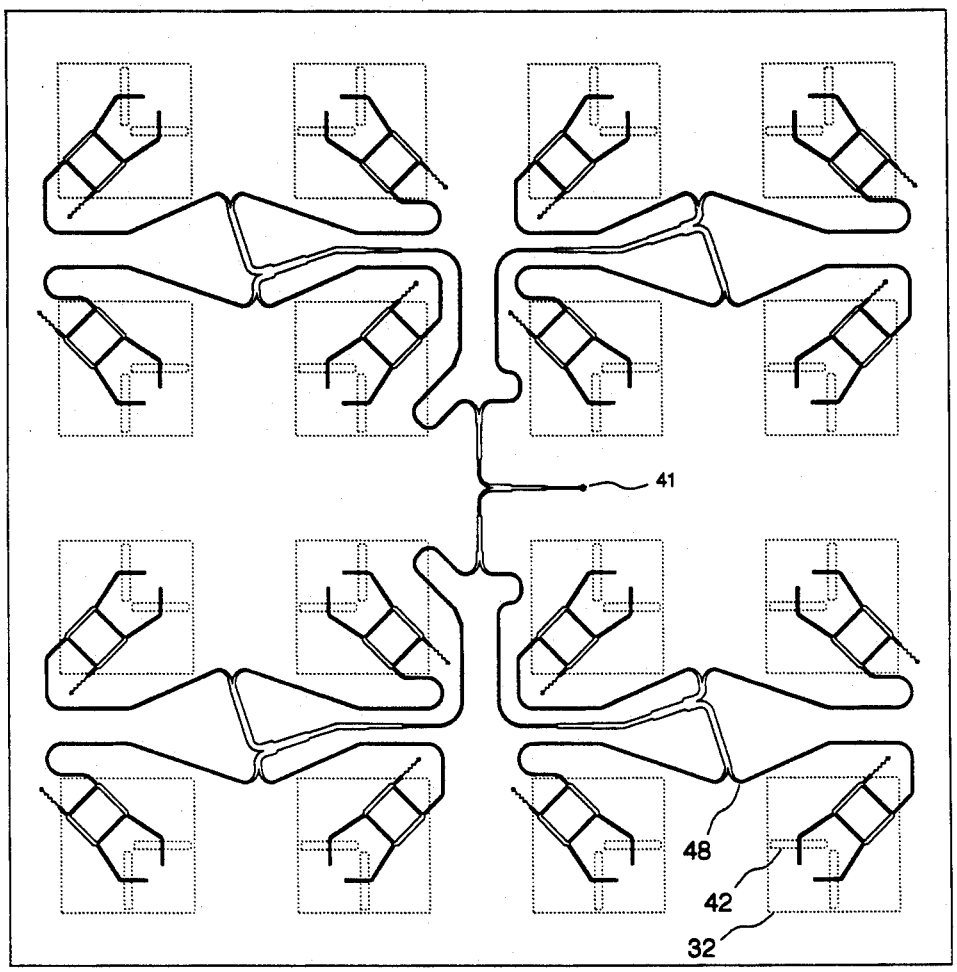
FIGS. 6 (*a*) and 6 (*b*) depict a top view and a cross sectional view, respectively, of a subarray element showing the alignment of the various layers including the microstrip feed network, the coupling slots and the patch radiators.
Figure 6B:
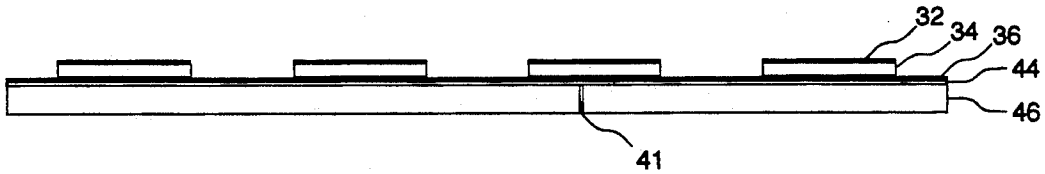

Referring now to FIG. 4, a silvered second surface mirror 32 is bonded to the top surface of each patch substrate 34 to form the patch radiator 31. The patch substrates 34 are made of a thermally stable low dielectric constant material such as fibrous refractory composite insulation material from Lockheed Corp. The patch antenna elements 31 are in turn attached to a larger silvered second surface mirror 36. So as not to obstruct the microwave signal power coupled to each patch radiator 31, the silver coating on the larger mirror 36 is removed in a plurality of areas 38 that correspond in shape and number with the plurality of patch radiators. The larger mirror 36 with patch radiators 31 is attached to the ground plane of a multilayered circuit board 40. Coupling slots 42 in the ground plane are aligned with the patch radiators 31. Referring now to FIG. 5, multilayered circuit board 40 comprises superstrate 46, microstrip feed network 48, substrate 44, and ground plane 43. The substrate 44 and superstrate 46 of feed network 48 share ground plane 43 with patch substrate 34 and are made of a dielectric material with high thermal conductivity such as aluminum nitride. The coupling slots 42 in ground plane 43 communicate microwave signal power between the feed network 48 and patch radiator 31. Referring now to FIG. 6, an input connector 41 to the microstrip feed network 48 is also provided for receiving microwave signal power. The complete subarray element 30 has silvered second surface mirrors covering the entire area of the top exterior surface allowing efficient radiation of heat and efficient reflection of solar power.

Figure 7:
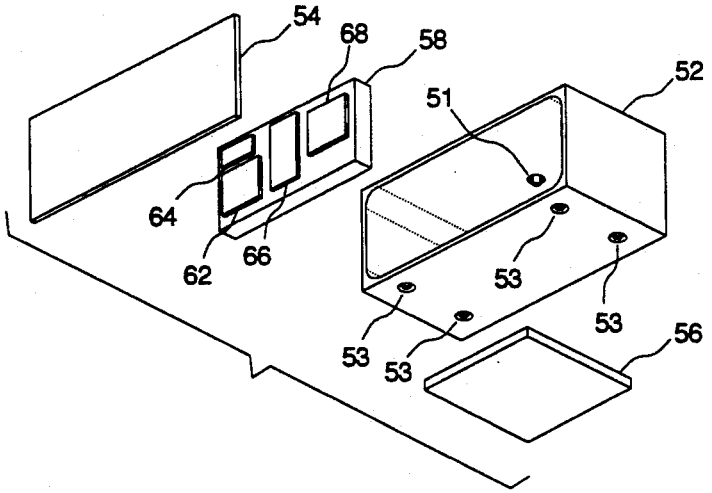
FIG. 7 depicts an exploded view of an electronics module showing the various components.
Figure 8A:
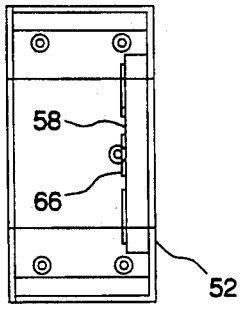
FIGS. 8 (*a*), 8(*b*), 8(*c*) and 8(*d*) depict top, end, side and isometric views, respectively, of an assembled electronics module
Figure 8D:
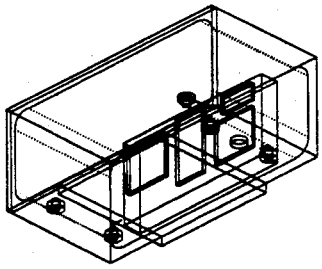
Figure 8B:
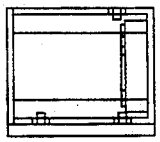
Figure 8C:
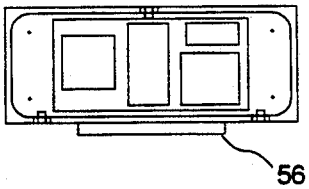
Figure 9:
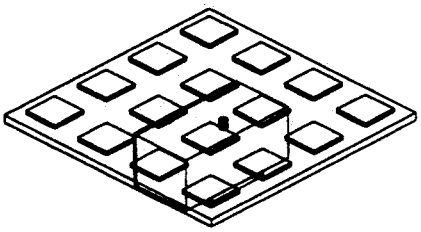
FIG. 9 depicts the attachment of the electronics module to a corresponding subarray element.

Referring now to FIGS. 7, 8, and 9, the electronics module 50 comprises housing 52, housing lid 54, thermal contact pad 56, small multilayered circuit board 58, monolithic microwave integrated circuit chips 62, 64, 66, and CMOS chip 68. Chip 62 may contain one or more phase shifters. Chip 64 may contain one or more variable attenuators. Chip 66 may contain one or more Solid State Power Amplifiers. Chip 68 may contain digital control circuitry for chips 62, 64 and 66. Chips 62, 64, 66, and 68 are mounted on a small multilayered circuit board 58 that is secured to an interior wall of the electronics module housing 52. The small multilayered circuit board 58 and the contact pad 56 are made out of a dielectric with high thermal conductivity such as aluminum nitride. Output connector 51 is electrically connected with small multilayered circuit board 58 and attaches to the connector 41 of the microstrip feed network 48. Input connectors 53 are also electrically connected with small multilayered circuit board 58. The dissipated heat in the active array panel is produced by the electronics modules 50 associated with the subarray elements 30. The electronics module 50 provides efficient conduction of heat away from the electronics devices.

Figure 10:
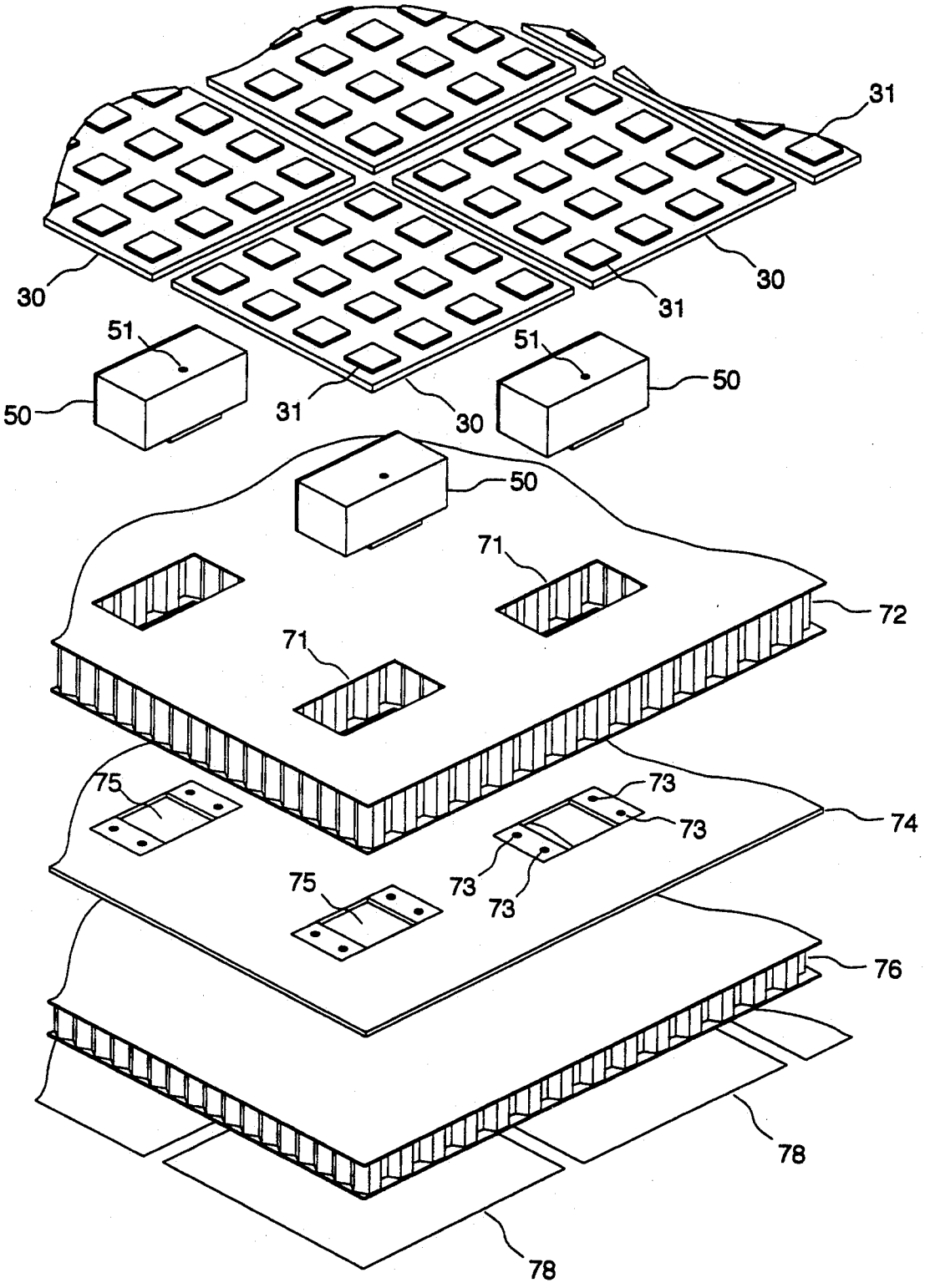
FIG. 10 depicts an exploded view of FIG. 2 showing the layered construction of the support structure assembly.

Referring to FIG. 10, support structure assembly 70 is constructed of a large multilayered board 74 with upper aluminum honeycomb panel 72 and lower aluminum honeycomb panel 76 bonded to each side. Alternatively, the support structure assembly 70 may be of a non-honeycomb configuration that will provide support and add rigidity to the overall array structure. The aluminum honeycomb panels provide a light rigid structure and high thermal conductivity. Silvered second surface mirrors 78 are bonded to the bottom exterior surface of the lower aluminum honeycomb panel 76 to provide efficient radiation of heat and a low absorption of solar power. The upper aluminum honeycomb panel 72 has portions cut out 71 that correspond in size to the electronics modules 50 and serve as receptacles for receiving said electronics modules. The large multilayered circuit board 74 contains signal and power distribution lines and can be made out of various microwave laminates such as Rogers Corp. TMM10. The multilayered board has output connectors 73 that attach to the input connectors 53 on the electronics module 50. Microwave signal power, DC power, and control signals are communicated through these connectors. A portion of large multilayered circuit board 74 is removed, as indicated by hole 75, for receiving the pad 56 on the electronic module 50. Pad 56 is thermally connected directly to lower aluminum honeycomb panel 76.

The thermal contact pad 56 and the large multilayered board 74 form an electrical insulating layer between the upper aluminum honeycomb panel 72 and lower aluminum honeycomb panel 76. Said electrical insulating layer allows the aluminum honeycomb panels to be used as a low loss transmission line for the low voltage high current DC bias power needed for the solid state power amplifiers. This eliminates the need for power conditioning electronics in the electronics module.

Figure 11:
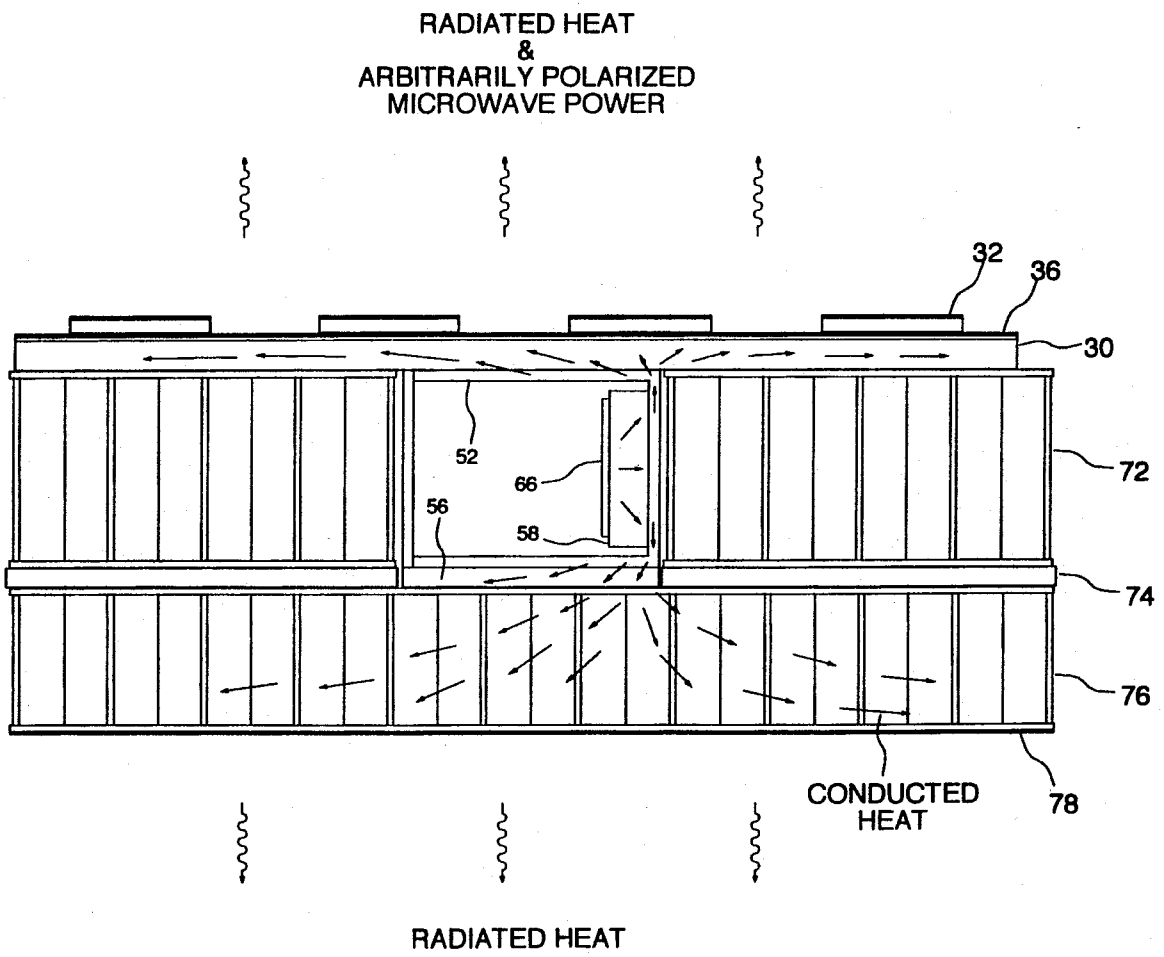
FIG. 11 depicts a cross sectional view of the assembled active array panel showing the heat transfer path.

The arrows shown within the aluminum structure, in FIG. 11, show the heat conduction paths. Heat generated by the solid state power amplifier chip 66 is conducted through the small multilayered circuit board 58 to the aluminum housing 52 from where it is transferred to both the subarray element 30 and lower aluminum honeycomb panel 76. Heat is then radiated from the top and bottom exterior surfaces into space by silvered second surface mirrors 32, 36, and 78.

The subarray elements 30 are constructed individually so as to allow easy replacement of defective electronics modules 50. In contrast, the support structure assembly 70 may be fabricated as a single piece that is the size of the entire panel. Also the multilayered circuit board 74 is preferably constructed as a single piece. This is depicted in the exploded view of FIG. 10 where the components of the support structure assembly are shown as continuing beyond the single subarray element.

There are many identical subarray elements 30 forming an active array panel, each with an associated electronics module which dissipates heat. Consequently, a large number of low power heat sources are uniformly distributed through the active array. The heat pipes, thermal doublers, and separate thermal radiating structures used in the prior art are therefore not needed, greatly reducing the weight of the payload.

What is claimed is:

1. An active phased array antenna panel for radiating both heat and arbitrarily polarized microwave signal power comprising;

a plurality of electronics modules, each of said electronics module including electronic circuit means comprising a plurality of electronic components including an amplifying means for amplifying microwave signal power, a phase shifting means for changing the phase of microwave signals, an attenuating means for attenuating microwave signals, and a digital control means for controlling said amplifying means, said phase shifting means and said attenuating means, a first multilayered circuit board made of a dielectric material with high thermal conductivity to which said electronic circuit means are attached in an electrical and heat conducting relationship, a housing made of a material with high thermal conductivity to which said first multilayered circuit board is attached in an electrical and heat conducting relationship, a plurality of input and output connector means attached to said housing and electrically connected to said electronic circuit means, a thermal contact pad made of dielectric material with high thermal conductivity, means for attaching said thermal contact pad to said housing in an electrical insulating and heat conducting relationship;

a plurality of subarray elements, each of said subarray element comprising a plurality of patch radiators, each of said patch radiator comprising a first mirror bonded to the top exterior surface of a patch substrate made of a thermally stable low dielectric constant material, a second multilayered circuit board made of a dielectric material with high thermal conductivity, said second multilayered circuit board including a microstrip feed network and a ground plane common to said microstrip feed network and to respective ones of said plurality of patch radiators, said microstrip feed network adapted to receive microwave signal power from said electronics module, said ground plane including a plurality of coupling slots for coupling said microwave signal power from said microstrip feed network through said ground plane to respective ones of said plurality of patch radiators, a second mirror having a plurality of areas with reflective coating removed corresponding in shape with respective ones of said plurality of patch radiators, means for bonding a plurality of said patch radiators to the top surface of said second mirror such that said plurality of patch radiators are aligned to respective ones of said plurality of areas with reflective coating removed, means to bond said second multilayered circuit board to the bottom surface of said second mirror such that said plurality of coupling slots are aligned to respective ones of said plurality of patch radiators;

a support structure assembly comprising a lightweight lower support structure made of a material with high electrical and thermal conductivity, a third mirror bonded to the bottom exterior surface of said lightweight lower support structure, a third multilayered circuit board comprising a plurality of imbedded transmission line layers for distributing microwave power, DC bias power, and control signals to respective ones of said plurality of electronics modules, a plurality of output connectors to receive input connectors on respective ones of said plurality of electronics modules, a plurality of holes in said third multilayered circuit board for receiving respective ones of said plurality of thermal contact pads on said electronics modules, a lightweight upper support structure made of a material with high electrical and thermal conductivity, said lightweight upper support structure including a plurality of holes corresponding in shape and adapted to receive respective ones of said plurality of electronics modules, means for attaching said third multilayered circuit board to the top surface of said lightweight lower support structure and to the bottom surface of said lightweight upper support structure to form a composite assembly, means for attaching said plurality of electronics modules to said support structure assembly in an electrical and heat conducting relationship, means for attaching said plurality of subarray elements to respective ones of said plurality of electronics modules in an electrical and heat conducting relationship.

2. The invention defined in claim 1 in which said lightweight upper support structure is positively charged and said lightweight lower support structure is grounded so as to supply said plurality of electronics modules with low voltage high current DC power.

3. The invention defined in claim 2 in which said lightweight upper support structure and said lightweight lower support structure are made of aluminum honeycomb construction.

4. The invention defined in claim 3 in which said mirrors are silvered Borosilicate glass mirrors.

5. The invention defined in claim 4 in which said heat conducting material is aluminum.

6. The invention defined in claim 5 in which said heat conducting dielectric material is aluminum nitride.

7. The invention defined in claim 6 in which the antenna is deployed from a spacecraft and allows thermal energy to be radiated from the outwardly facing surfaces of each panel into space.

8. The invention defined in claim 2 in which said microstrip feed network and said plurality of coupling slots in said second multilayered circuit board are adapted to provide circular polarized microwave power of either sense.

9. The invention defined in claim 2 in which said microstrip feed network and said plurality of coupling slots in said second multilayered circuit board are adapted to provide linear polarized microwave power of either sense.

* * * * *